US006665646B1

(12) United States Patent
John et al.

(10) Patent No.: US 6,665,646 B1
(45) Date of Patent: Dec. 16, 2003

(54) PREDICTIVE BALANCED MULTIPLE DESCRIPTION CODER FOR DATA COMPRESSION

(75) Inventors: Sam John, Randolph, NJ (US); Vinay A. Vaishampayan, Summit, NJ (US)

(73) Assignee: AT&T Corp., New York, NY (US)

( * ) Notice: Subject to any disclaimer, the term of this patent is extended or adjusted under 35 U.S.C. 154(b) by 0 days.

(21) Appl. No.: 09/458,659

(22) Filed: Dec. 10, 1999

Related U.S. Application Data

(60) Provisional application No. 60/111,889, filed on Dec. 11, 1998, and provisional application No. 60/117,407, filed on Jan. 27, 1999.

(51) Int. Cl.[7] ..... G10L 19/00
(52) U.S. Cl. ..... 704/500
(58) Field of Search ..... 704/500

(56) References Cited

U.S. PATENT DOCUMENTS 5,576,765 A * 11/1996 Cheney et al. ..... 375/240.02
5,651,090 A * 7/1997 Moriya et al. ..... 704/200.1
5,740,283 A * 4/1998 Meeker ..... 382/248
5,777,679 A * 7/1998 Cheney et al. ..... 375/240.15
5,867,602 A * 2/1999 Zandi et al. ..... 382/233
6,195,465 B1 * 2/2001 Zandi et al. ..... 382/233
6,292,589 B1 * 9/2001 Chow et al. ..... 348/416.1
6,377,914 B1 * 4/2002 Yeldener ..... 704/205

OTHER PUBLICATIONS

Ingle et al, "DPCM System Design for Diversity Systems with Applications to Packetized Speech", *IEEE Transactions on Speech and Audio Processing*, vol. 3, No. 1, pp 48–58, publication of the IEEE Signal Processing Society.

Vaishampayan, V.A., "Design of Multiple Description Scalar Quantizers", *IEEE Transactions on Speech and Audio Processing,* vol. 39, No. 3, pp 821–835, The Institute of Electrical and Electronics Engineers, Inc.New York, New York.

Vaishampayan et al, "Speech Predictor Design for Diversity Communication Systems", Proceedings 1995 IEEE Workshop on Speech Coding for Telecommunications, *Speech Coding for Interoperable Global Communications,* Annapolis, Maryland, Sep. 20–22, 1995.

* cited by examiner

*Primary Examiner*—Doris H. To
*Assistant Examiner*—Michael N. Opsasnick

(57) ABSTRACT

A balanced multiple descriptive coder codes data in streams so that an acceptable replica of source data can be generated if either stream is lost. The balanced multiple descriptive coder may include a pair of coding branches, each branch including a coding chain and a prediction chain.

34 Claims, 8 Drawing Sheets bin index i

| bin index j | -4 | -3 | -2 | -1 | 0 | 1 | 2 | 3 | 4 |
|---|---|---|---|---|---|---|---|---|---|
| -4 | -8 | -7 | | | | | | | |
| -3 | | -6 | -5 | | | | | | |
| -2 | | | -4 | -3 | | | | | |
| -1 | | | | -2 | -1 | | | | |
| 0 | | | | | 0 | 1 | | | |
| 1 | | | | | | 2 | 3 | | |
| 2 | | | | | | | 4 | 5 | |
| 3 | | | | | | | | 6 | 7 |
| 4 | | | | | | | | | 8 |

FIG. 3

PRIOR ART bin index i

| bin index j | -4 | -3 | -2 | -1 | 0 | 1 | 2 | 3 | 4 |
|---|---|---|---|---|---|---|---|---|---|
| -4 | -12 | -11 | | | | | | | |
| -3 | -10 | -9 | -7 | | | | | | |
| -2 | | -8 | -6 | -5 | | | | | |
| -1 | | | -4 | -3 | -1 | | | | |
| 0 | | | | -2 | 0 | 1 | | | |
| 1 | | | | | 2 | 3 | 5 | | |
| 2 | | | | | | 4 | 6 | 7 | |
| 3 | | | | | | | 8 | 9 | 11 |
| 4 | | | | | | | | 10 | 12 |

PREDICTIVE BALANCED MULTIPLE DESCRIPTION CODER FOR DATA COMPRESSION

RELATED APPLICATIONS

This application may benefit from the priority of U.S. patent application Ser. No. 60/111,889 filed Dec. 11, 1998 and U.S. patent application Ser. No. 60/117,407 filed Jan. 27, 1999, the disclosures of which are incorporated herein by reference.

BACKGROUND

Data compression applications are used for various types of data including audio data, video data and executable content. Typically, data compression occurs at an encoder. The compressed data may be delivered to a decoder via a channel and decompressed into a replica (or sometimes an exact duplicate) of the source data.

Various data compression designs are available in the art. They typically reflect two competing interests. On one hand, it is desirable to eliminate all redundancies from a source data signal so that the compressed data signal occupies as little bandwidth as possible when it is placed in a channel. One the other hand, it becomes necessary to ensure that some amount of redundancy remains in the compressed data signal to make it possible to perform data decompression even in the face of data corruption that may be caused by channel imperfections.

Known "layered" coders (or "hierarchical" or "embedded" coders) attempt to harmonize these competing interests. A layered coder generates a compressed data signal that consists of two or more layers of coded data. These layers are often referred to as "streams." A first "base" layer of coded data represents basic information about the source data signal. If decompression were performed solely upon the base layer, it would be possible to obtain an acceptable and usable representation of the source data signal. Layered coder typically provides additional information in one or more enhancement layers that, when decoded together with the base layer, refine the estimate that is obtained from the base layer. The enhancement layers typically do not completely represent the source data.

In a layered coder, the base layer is critical because a usable replica of the source signal cannot be obtained without it. Such coders are disadvantageous because it may not always be possible to ensure that the base layer is available at the decoder. Accordingly, there is a need in the art for a coding system that generates multiple streams with the property that a usable replica can be decoded from any single stream. Further, there is a need in the art for a coding system that generates such streams with sufficient data compression.

SUMMARY OF THE INVENTION

The present invention provides a balanced multiple descriptive coder, one that codes data in streams so that an acceptable replica of source data can be generated if either stream is lost.

BRIEF DESCRIPTION OF THE DRAWINGS

FIG. 3 illustrates a second exemplary index assignment scheme.

DETAILED DESCRIPTION

The present invention provides a predictive balanced multiple description coding system. An encoder generates two streams of compressed data signals from source data and outputs the streams to a channel, typically a packet switched network. The decoder can generate a usable replica of the source data signal from any one of the streams. If all of the layers are received, the decoder can generate an improved replica of the source data signal.

Figures 1, 2:
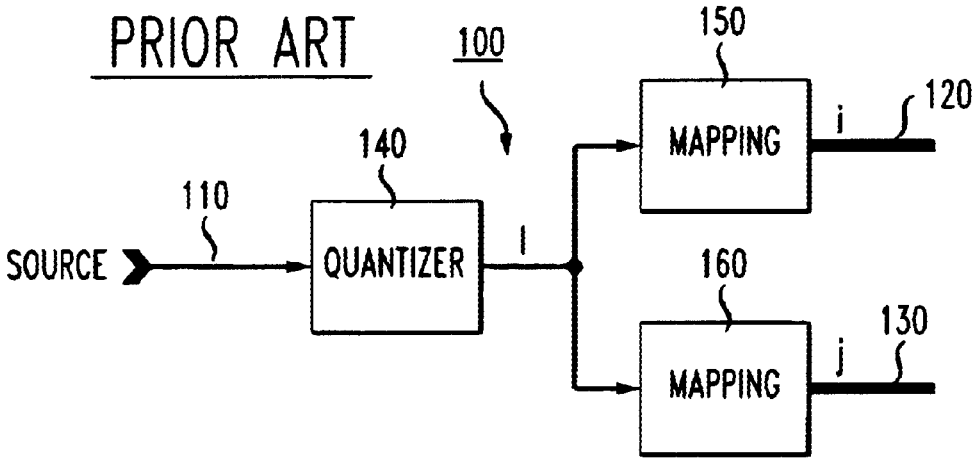
FIG. 1 PRIOR ART
FIG. 2 PRIOR ART
FIG. 1 is a block diagram of a balanced multiple descriptive coder.
FIG. 2 illustrates a first exemplary index assignment scheme.

A balanced multiple descriptive coder is known per se. FIG. 1 is a block diagram of a conventional balanced multiple description coder 100. Two channels connect the coder 100 to a decoder (not shown). Each channel supports a rate of R bits/source sample. When both channels carry data, a decoder is able to reconstruct a high-quality representation of the source signal s(t). When only one channel carries data, the decoder is able to reconstruct a usable representation of the source signal s(t).

As shown in FIG. 1, the coder 100 may include the input terminal 110 for source data s(t) and a plurality of output terminals 120, 130 for output data. The coder 100 is populated by a quantizer 140 and a plurality of mapping units 150, 160.

The quantizer 140 may operate as conventional quantizers do. The quantizer 140 requantizes a source sample s(t) to yield an integer index according to $l(t)=q(s(t))$ where the $q(\cdot)$ function represents a quantization function. In one example, $q(\cdot)$ may be a uniform threshold quantization function. In a simple case, $q(\cdot)$ may represent division by a quantizer step size Q followed by rounding. Herein, the output signal l(t) is called the "central index."

Each of the mapping units 150, 160 perform an index assignment that generates a pair of bin indices (i(t), j(t)) from the central index l(t) according to predetermined mapping functions $a_1(\cdot)$, $a_2(\cdot)$. The mapping functions reflect a predetermined index assignment. Bin index i(t) may be further coded and placed in a first channel. Bin index j(t) also may be further coded and placed in a second channel.

The mapping units 150, 160 may operate in accordance with predetermined index assignment schemes. FIGS. 2 and 3 illustrate index assignment tables reflecting two different index assignment schemes. Consider the index assignment table of FIG. 2 first. There, the table includes a plurality of cells, most of which are empty. Values of l(t) are provided in the non-empty cells of the table. For each value of l(t) there is only one cell in the table occupied by that value. Thus, in the exemplary table of FIG. 2, l=−1 is found in the cell at (i=0, j=−1) and no other.

Index assignment schemes are characterized by their reuse index (N) and spread. The reuse index refers to the number of central indices l(t) that can be accessed by a single bin index i(t) or a single bin index j(t). In the example of FIG. 2, the reuse index N is 2. In the example of FIG. 3, the reuse index N is 3.

Spread refers to a difference between the largest and smallest central index in each row or column. In the index assignment table of FIG. 2, the spread in each row and column is 1. For a perfectly balanced multiple descriptive coder, the spread will be the identical among columns and rows of its index assignment table.

The spread determines the distortion imposed upon the decoding of the central index when one of the channels fail. Consider an example where the quantizer 140 generates a central index l=2. According to the index assignment table of FIG. 2, bin index i=1 and bin index j=1. At a decoder, if the channel that includes bin index j were lost, a decoder could not determine l with precision. Using the surviving bin index, bin index i, the decoder would determine that l=1 or 2. In the absence of a precise description of l, the decoder could estimate l according to some predetermined estimation process. According to the index assignment table of FIG. 3 where the spread is 3, a different degree of distortion is introduced in the event of channel failure than would be introduced by the index assignment scheme of FIG. 2. Again, in the absence of one of the bin indices, the central index is reconstructed as one of several values.

Figure 4:
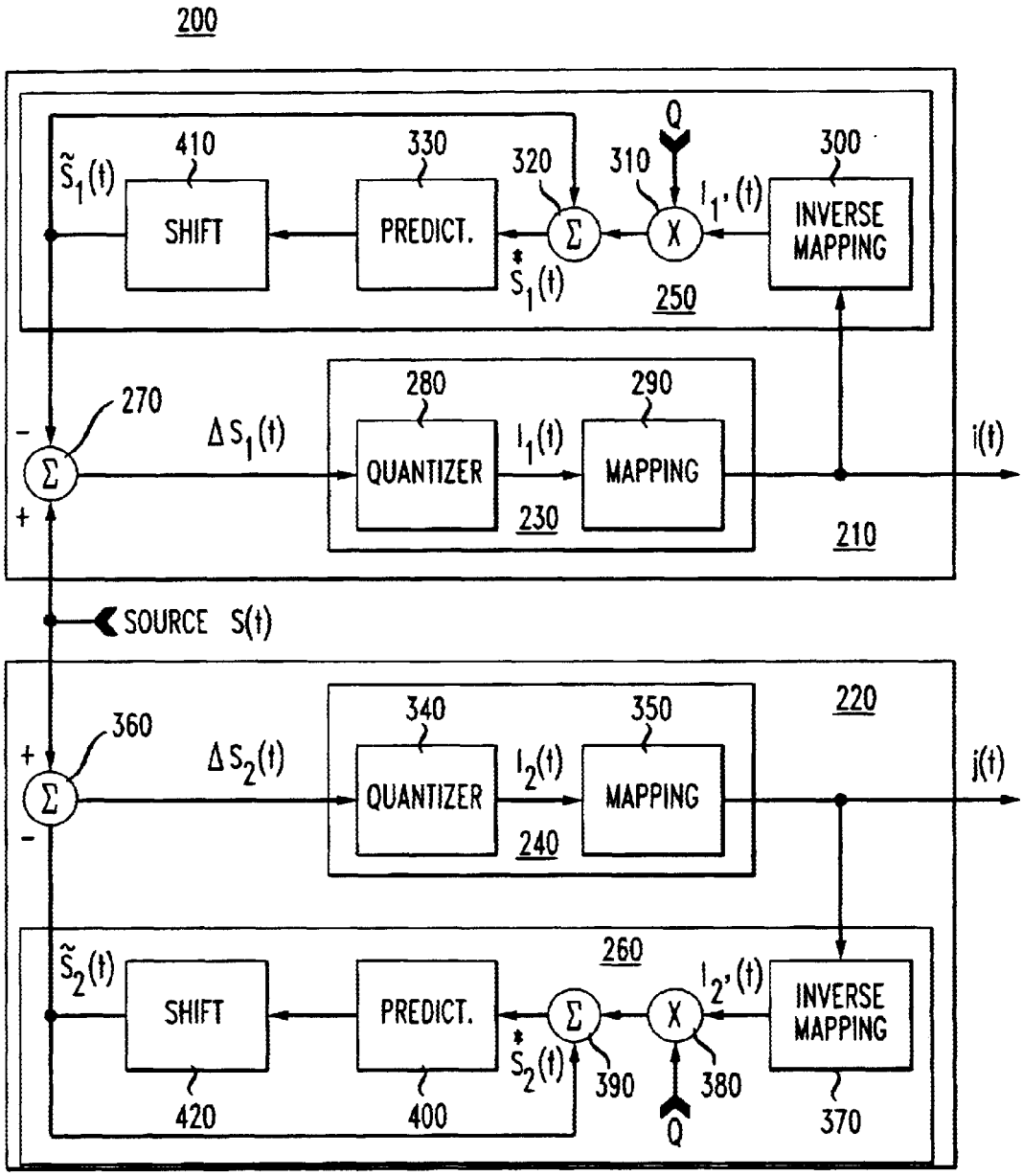
FIG. 4 is a block diagram of a balanced multiple descriptive coder according to an embodiment of the present invention.

FIG. 4 is a block diagram of a balanced multiple description coder 200 according to an embodiment of the present invention. The embodiment of FIG. 4 provides a balanced multiple description coder 200 that employs predictive techniques. The balanced multiple description coder 200 includes a pair of branch coders 210, 220. Each of the branch coders 210, 220 may include a coding chain 230, 240 and a prediction circuit 250, 260.

Within the first branch coder 210, source data s(t) is input to a subtractor 270. A predicted value of the source data $\tilde{s}_1(t)$ is input to a second input of the subtractor 270. The subtractor 270 generates a differential signal $\Delta s_1(t)$ representing a difference between the source signal s(t) and the predicted source signal $\tilde{s}_1(t)$. The differential signal $\Delta s_1(t)$ is input to the first coding chain 230.

The, first coding chain 230 may include a quantizer 280 and a mapping unit 290. The quantizer 280 requantizes the differential signal $\Delta s_1(t)$ and generates an output that is used as a first central index signal $l_1(t)$. The mapping unit 290 generates a first bin index signal i(t) from the central index signal $l_1(t)$. It outputs the bin index signal i(t) to the first channel and to the prediction circuit 250.

The prediction circuit 250 may include an inverse mapping unit 300, a multiplier 310, an adder 320, a predictor 330, and a shifting circuit 410. The inverse mapping circuit 270 reconstructs a central index signal $l_1'(t)$ based upon the bin index signal i(t). This reconstructed central index signal $l_1'(t)$ has a value that would be obtained by decoding the first bin index signal i(t) only—as if the channel carrying the j(t) signal had failed. The multiplier 310 scales the reconstructed central index signal $l_1'(t)$ in a manner that inverts the quantization of the quantizer 280. The adder 320 reintroduces the value of the predicted source signal $\tilde{s}_1(t)$ that had been subtracted by the subtractor 270. The subtractor 270 generates a signal $\dot{s}_1(t)$ that represents a reconstruction of the source signal s(t).

The reconstructed source signal $\dot{s}_1(t)$ is input to the predictor 330. An output of the predictor 330 is input to a shifting circuit 410. The predictor 330 selects data from a reconstructed source signal $\dot{s}_1(t)$ at one time instant as a basis for prediction of the source signal s(t) at another time instant. The shifting circuit 410 may scale the signal according to a mutual refinability property for the index assignment scheme. The shifting circuit outputs a predicted source signal $\tilde{s}_1(t)$ to the adder 320 and the subtractor 270.

The second coding branch 220 possesses a similar structure to the first coding branch 210. The second coding branch 220 may be populated by a coding 240 chain that includes a quantizer 340 and a mapping unit 350. A subtractor 360 receives the source signal s(t) on a first input and a second predicted source signal $\tilde{s}_2(t)$ on a second input. It outputs a differential signal $\Delta s_2(t)$ to the quantizer 340. The quantizer 340 generates a second central index signal $l_2(t)$ from the differential signal $\Delta s_2(t)$. The mapping unit 350 generates a second bin index signal j(t) based upon the second central index $l_2(t)$. The second bin index signal j(t) is output to the second channel and to the second prediction circuit 260.

The second prediction circuit 260 may include an inverse mapping unit 370, a multiplier 380, an adder 390, a predictor 400 and a shifting circuit 420. The inverse mapping unit 370 reconstructs the second central index signal $l_2'(t)$ based solely upon the bin index signal j(t). The multiplier 380 scales the second reconstructed central index signal $l_2'(t)$ to invert the processing of the quantizer 340. The adder 390 adds the predicted value of the source data $\tilde{s}_2(t)$ that had been subtracted by the subtractor 360; it outputs a reconstructed source data signal $\dot{s}_2(t)$.

The predictor 400 selects data from the reconstructed source signal $\dot{s}_2(t)$ at one time instant as a basis for prediction of the source signal s(t) at another time instant. The second shifting circuit 420 may scale the signal according to the mutual refinability property. The second shifting circuit 420 outputs a predicted source signal $\tilde{s}_2(t)$ to the adder 390 and the subtractor 360.

According to an embodiment of the present invention, the prediction circuits 260, 330 from each coding branch 210, 220 each perform an inverse map based solely upon the branch's respective bin index i(t) or j(t). Thus, inverse mapping unit 300 of the first coding branch 210 generates a first reconstructed central index signal $l_1'(t)$ based solely on the first bin index i(t); the inverse mapping unit 370 of the second coding branch 220 generates a second reconstructed central index signal $l_2'(t)$ based on solely on the second bin index j(t). Thus, these reconstructed signals are created independently from each other and may have different values as the encoder 200 operates. Differences in the reconstructed signals $l_1'(t)$ and $l_2'(t)$ may lead to differences in the reconstructed source signals $\dot{s}_1(t)$ and $\dot{s}_2(t)$ and in the predicted source signals $\tilde{s}_1(t)$ and $\tilde{s}_2(t)$.

According to an embodiment of the present invention, the first and second predictors 330, 400 may be general finite impulse response filters with transfer function $H(z)=h_1z^{-1}+h_2z^{-2}+\ldots h_kz^{-k}$. For example, the predictors may be single sample delay elements $H(z)=z^{-1}$.

Figure 5A:
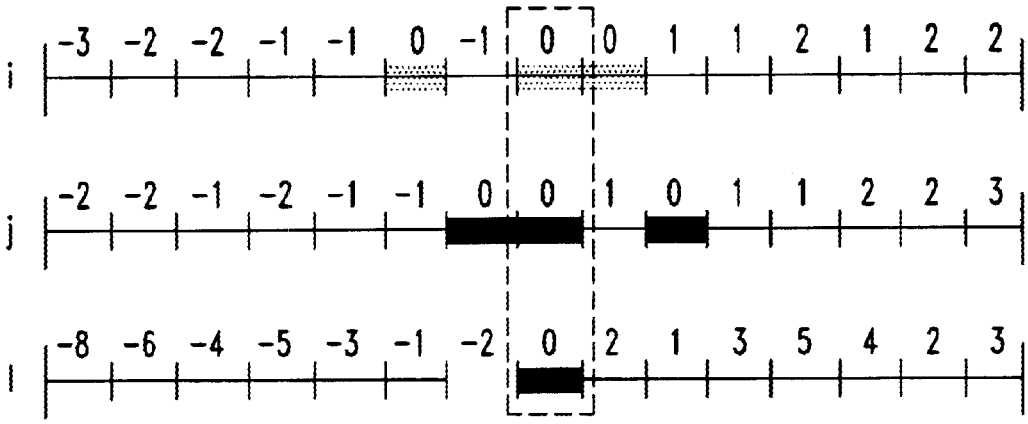
FIGS. 5(*a*)–(*c*) illustrate mutual refinability under shifts for index assignment schemes according to an embodiment of the present invention.
Figure 5B:
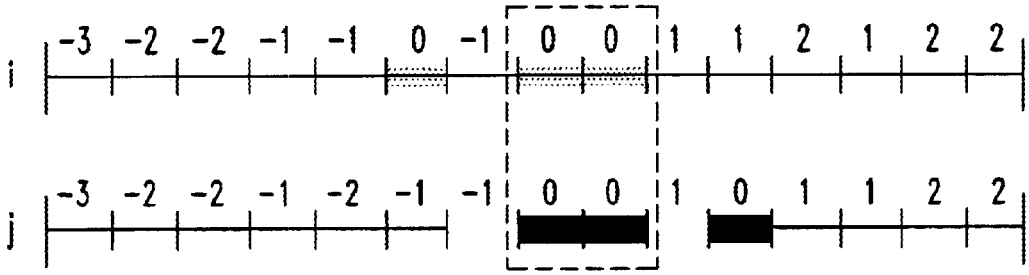
Figure 5C:
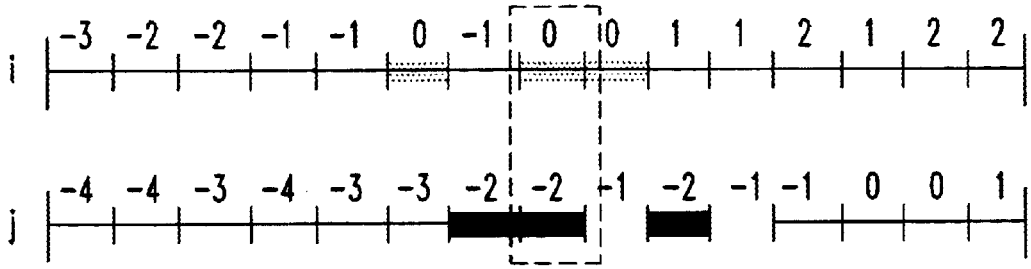

The embodiment of FIG. 4 exploits a property of the balanced multiple descriptive coder called "mutual refinability". As described with respect to FIGS. 2 and 3, the index assignment scheme is one-to-one: For every bin index combination, the bin indices intersect at most one non-empty central index position. FIG. 5(*a*) illustrates the index assignment scheme of FIG. 3, demonstrating that any given pair of bin indices (e.g. i=0, j=0) intersects over a single central index (l=0). In the design of a predictive multiple description system, the resulting assignment is obtained by shifting i relative to j. FIG. 5(*b*) illustrates, however, that indiscriminate shifts may cause the index assignment scheme to lose the single intersection property. FIG. 5(*b*) illustrates a one-position shift which causes i=0, j=0 to intersect at a pair of non-empty central indices, not just one central index.

A six-position shift, however, maintains the one-to-one mapping property of the index assignment scheme of FIG. 5(*a*). The six-position shift is shown in FIG. 5(*c*). Accordingly, an index assignment scheme is said to be "mutually refinable under shifts" having period M if M is a finite integer representing the smallest number of shift positions that maintains the singular intersection property.

The mutual refinement property is advantageous because, when both channels work, it ensures that the quantizer error is bounded by half of the quantizer step size.

Returning to FIG. 4, the prediction branches include shifters 410, 420 that exploit the periodicity of the index assignment scheme. Consider shifter 410 first. Given a locally decoded value of the source signal $\hat{s}_1(t)$, the shifter 410 may quantize the locally decoded source signal as:

$$\tilde{s}_1(t) = MQ\left\lfloor \frac{\sum_i h_i \hat{s}_1(t-i)}{MQ} + \frac{1}{2} \right\rfloor \tag{1}$$

where M is the mutually refinable shift period of the index assignment scheme, Q is the quantizer scalar. This shift has an effect of rounding the estimate of the predicted source signal $\tilde{s}_1(t)$ to the to the closest available shifted position in the index assignment scheme that satisfies mutual refinability. The second shifter 420 also operates according to this principle.

Thus, the present invention provides a predictive balanced multiple description encoder. The encoder possesses an advantageous property in that the encoder generates coded data streams on two independent properties in such a way that, if one stream were lost entirely, a useful replica of a source signal could be recovered based on the other stream.

Several enhancements are available to further improve the operation of the balanced multiple description encoder. According to the present invention, the balanced multiple description coder may be further enhanced according to any of the following:

source transform encoding prior to index assignment;

motion compensated temporal prediction; and multiple index assignments in a coding branch.

Each of these embodiments may be applied independently from the other. They are described with reference to FIGS. 6 and 7.

Figure 6:
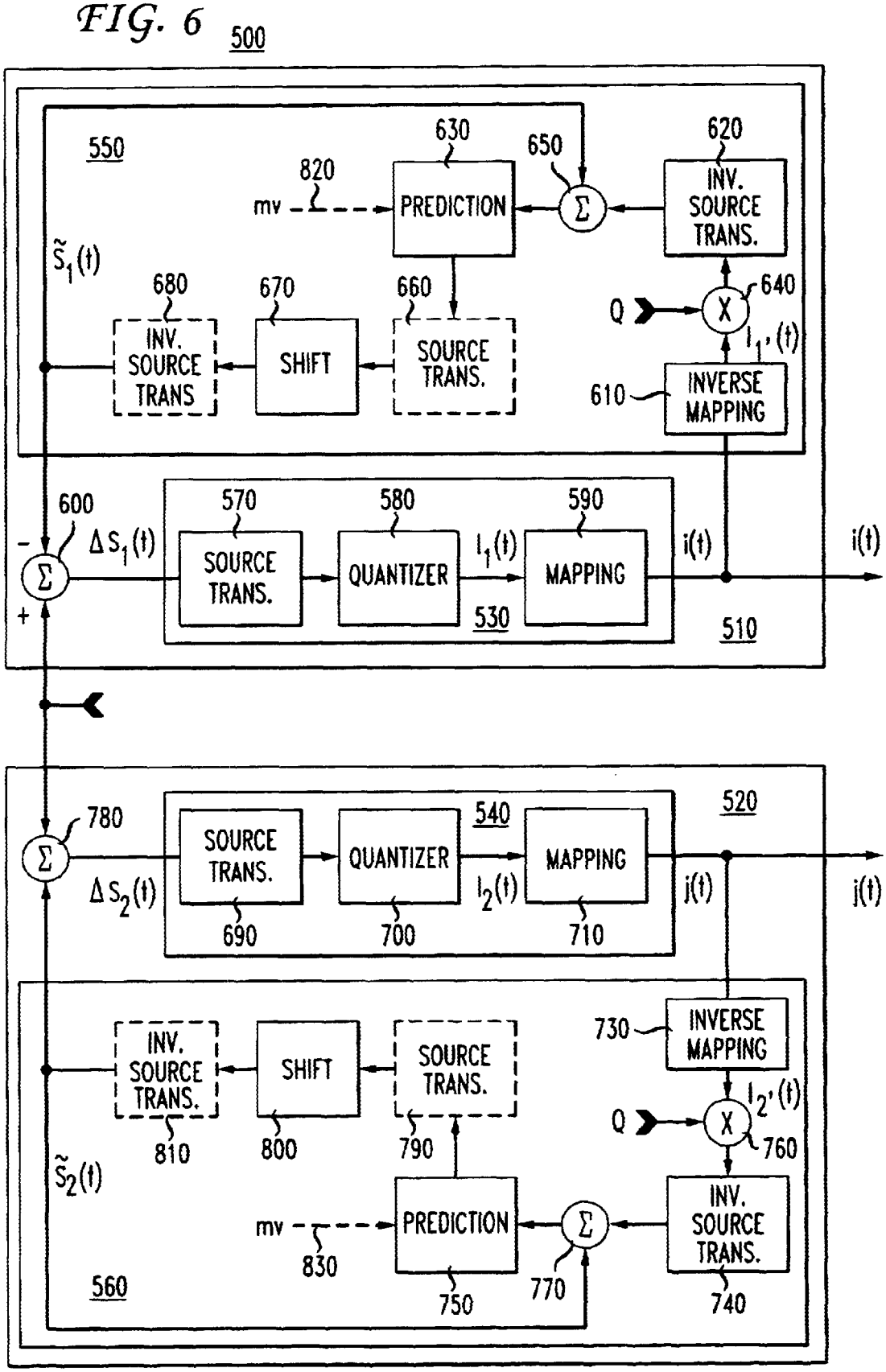
FIG. 6 is a block diagram of a balanced multiple descriptive coder according to a further embodiment of the present invention.

FIG. 6 illustrates a balanced multiple descriptive coder 500 according to an embodiment of the present invention. FIG. 5 illustrates a pair of coding branches 510 and 520, each being populated by a coding chain 530, 540, and a prediction circuit 550, 560. Considering the first coding branch 510 first, the encoding circuit 530 may be populated by a source transformation 570, a quantizer 580 and a mapping unit 590. An input source signal s(t) is input first to a subtractor 600. The subtractor 600 outputs a differential signal $\Delta s_1(t)$ based upon a difference between the source signal s(t) and a first predicted signal $\tilde{s}_1(t)$. The differential signal $\Delta s_1(t)$ is input to the encoding circuit 530.

The source transformation 570 typically tailors the encoder 500 for use with a predetermined type of data signal such as video. Thus, the source transformation 570 codes the differential signal according to an algorithm that takes advantage of certain redundancies that characterize the source data s(t). Exemplary transformations for video include: discrete cosine transform (DCT), fast Fourier transform (FFT), and wavelet transform (WT). The source transformation 570 outputs a coded signal to the quantizer 580.

The quantizer 580 and mapping unit 590 operate according to the techniques described above with respect to the previous embodiments. The quantizer 580 may perform data truncation upon the coded signal from the source encoder 570, outputting a signal that is used as the central index signal $l_1(t)$. The mapping unit 590 generates a bin index signal i(t) from the central index signal $l_1(t)$. The bin index signal is output to the first channel and to the prediction circuit 550.

The prediction circuit 550 may be populated by an inverse mapping unit 610, a source decoder 620, a predictor 630, a multiplier 640, an adder 650 and a shifting circuit 670. The inverse mapping unit 610 generates a reconstructed central index $l_1'(t)$ from the bin index signal i(t). The multiplier 640 scales the reconstructed index signal $l_1'(t)$ by a multiplying factor Q that inverts the quantization applied by the quantizer 580. The source decoder 620 inverts the transformation that had been applied by the source transformation 570. The adder 650 reintroduces the predicted signal $\tilde{s}_2(t)$ that had been subtracted by subtractor 600.

The prediction circuit 630 selects data from the reconstructed source data signal at one time instant as a basis for prediction of the source signal at another time instant. The shifting circuit 670 exploits the mutual refinability property as discussed above.

In an embodiment employing source transformations in the coding chain 530, the prediction chain also may include a second source transformation 660 and inverse source transform 680 coupled to inputs and outputs of the shifting circuit 670, respectively. Such an embodiment permits the shifting circuit 670 to operate in a domain of source transformed data.

The second coding branch 520 may possess the same structure as the first coding branch 510. It may be populated by a second encoder chain 540 and a second prediction circuit 560. The encoder chain 540 may include a source transform 690, a quantizer 700 and a mapping unit 710. The mapping unit 710 outputs a second bin index signal j(t) to a channel and to the prediction circuit 560.

The structure of the second prediction circuit 560 parallels that of the first prediction circuit 550. The second prediction circuit 560 may be populated by an inverse mapping unit 730, an inverse source transform 740, a prediction circuit 750, a multiplier 760, an adder 770, and a shifter 800. Optionally, source transformations 790 and inverse source transformations 810 may be provided on inputs and outputs of the shifter 800, respectively.

Thus, an embodiment permits the advantages of source coding transforms to be integrated with a balanced multiple descriptive coder.

In another embodiment, the encoder 500 benefit from motion compensated temporal prediction. According to such an embodiment, the predictors 630 and 750 may accept motion vectors on inputs 820, 830, respectively, and predict source data using both temporal and spatial prediction. This embodiment finds application in video coding applications.

As is known, source data for video includes both spatial and temporal references. For example, video data may be organized into frames, each frame being represented as a two-dimensional array of display data. Motion vectors, generally, identify display data from a spatial region in another frame that can be used as a basis for prediction of source data in a current position of a current frame.

In this embodiment, source data s(t) and reconstructed source data $\dot{s}(t)$ may possess both temporal and spatial references. The prediction circuits 630 and 750 may store an entire frame of reconstructed source data $\dot{s}(t)$. In response to motion vectors generated in the encoder (not shown), the predictors may output a portion of the stored reconstructed source data identified by the motion vectors as a predicted source signal. The motion vectors may be generated at the encoder according to any of a number of conventional techniques.

Figure 7:
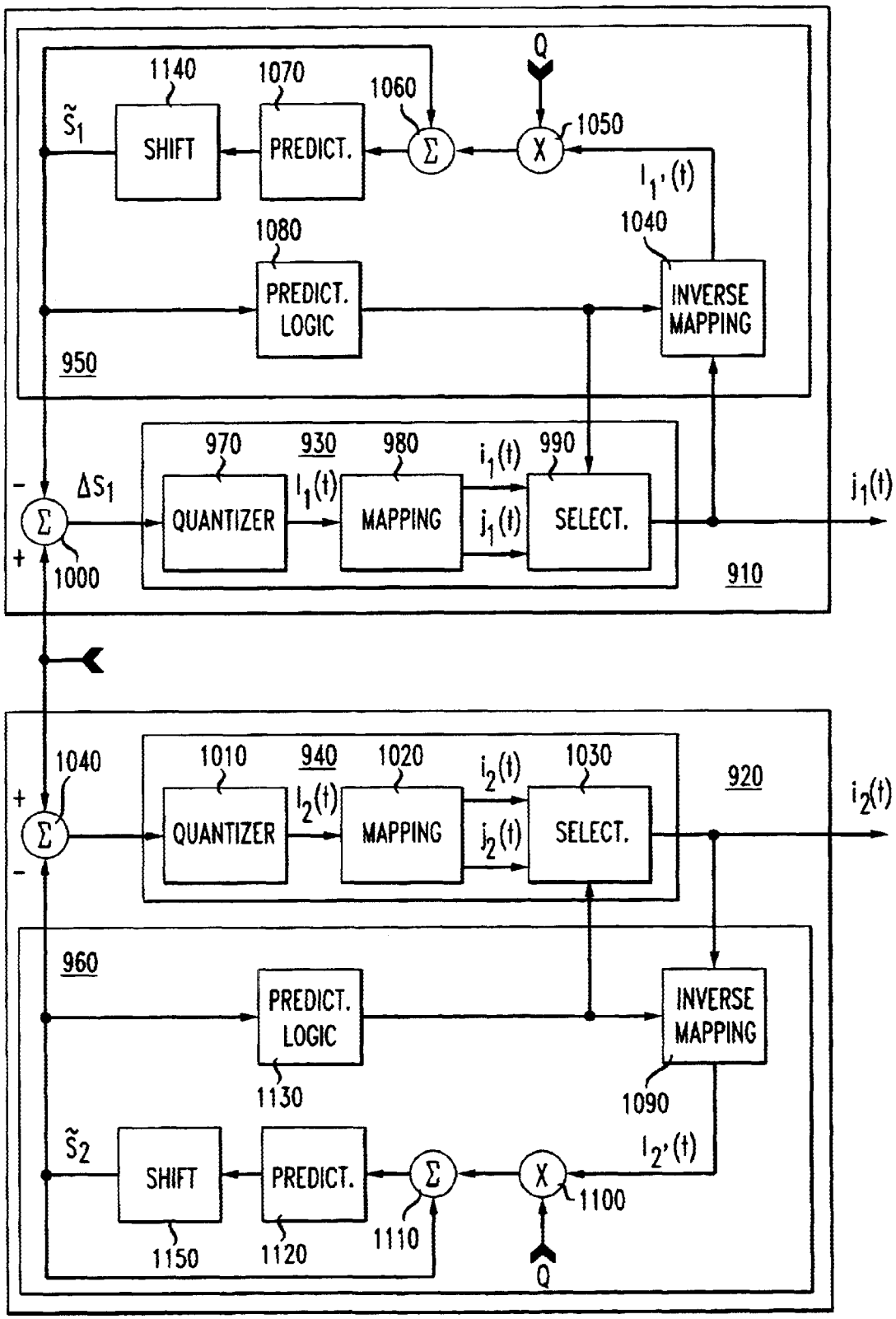
FIG. 7 is a block diagram of a balanced multiple descriptive coder according to an embodiment of the present invention.

FIG. 7 illustrates a balanced multiple description coder 900 according to another embodiment of the present invention. As with prior embodiments, the coder 900 includes a pair of coding branches 910, 920, each coding branch including a coding chain 930, 940 and a prediction circuit 950, 960.

The first coding chain 930 is populated by a quantizer 970, a mapping unit 980 and a selector 990. The quantizer 970 receives a differential signal $\Delta s_1(t)$ from a subtractor 1000, requantifies it according to a quantizer scalar and outputs the requantified signal as the central index signal $l_1(t)$. The mapping unit 990 generates two bin index signals $i_1(t)$, $j_1(t)$ from the central index signal $l_1(t)$. Both bin index signals $i_1(t)$, $j_1(t)$ are input the selector 990. The selector 999 outputs one of the bin index signals (say, $j_1(t)$) and outputs it both to the first channel and to the prediction circuit 950.

The second coding chain 940 possesses a structure that parallels the structure of the first coding chain 930. It may include a quantizer 1010, a mapping unit 1020 and a selector 1030. The quantizer 1010 receives a second differential signal $\Delta s_2(t)$ from a subtractor 1040, requantifies it and outputs a second central index signal $l_2(t)$. The mapping unit 1020 generates a second pair of bin index signals $i_2(t)$, $j_2(t)$ from the second central index signal $l_2(t)$. Both bin index signals $i_2(t)$, $j_2(t)$ are input the selector 1030. The selector 1030 outputs one of the bin index signals (say, $i_2(t)$) and outputs it both to the second channel and to the second prediction circuit 960.

The first prediction circuit 950 may be populated by an inverse mapping unit 1040, a multiplier 1050, an adder 1060, a predictor 1070, and a shifting circuit 1140 operating in accordance with the previous embodiments. The first prediction circuit 950 also may include prediction analyzer 1080 that controls operation of the selector 990 and the inverse mapping unit 1040 based on the predicted source data signal. For example, in an embodiment having the index assignment of FIG. 5, the prediction logic 1080 causes the selector 990 to output $i_1(t)$ to the channel if the predicted source signal $\tilde{s}_1(t)$ is an even multiple of 3Q. Otherwise the prediction logic 1080 causes the selector 990 to output the second bin index $j_1(t)$. For N=2, the logic unit always outputs $i_1(t)$.

Similarly, the second prediction circuit 960 may be populated by an inverse mapping unit 1090, a multiplier 1100, an adder 1110, a predictor 1120, and a shifting circuit 1150 that operates according to previous embodiments. The second prediction circuit 960 also may include prediction logic 1130 that controls operation of the selector 1030 and the inverse mapping unit 1090 in the second coding branch 920 based on the second predicted source data signal. For example, in an embodiment having the index assignment of FIG. 5, the prediction logic 1130 causes the selector 1030 to output $i_2(t)$ to the channel if $\tilde{s}_2(t)$ is an odd multiple of 3Q. Otherwise, the prediction logic 1130 causes the selector 1030 to output the second bin index signal $j_2(t)$ to the second channel. For N=2, the logic unit always outputs $j_2(t)$.

The embodiment illustrated in FIG. 7 maintains mutual refinability for shifts that are smaller than the minimum period M defined with respect to FIG. 6. This embodiment maintains refinability for shift of 3 for the index assignment shown in FIG. 6.

As noted, the enhancements introduced with respect to FIGS. 6 and 7 may be employed independently from one another. Thus, while it may be advantageous to provide a predictive balanced multiple descriptive coder that includes source transformation, motion compensated prediction and multiple index assignment predictions per branch, the principles of the present invention are not so limited. The principles of the present invention permit a predictive balanced multiple descriptive coder having source transformation per se, motion compensated prediction per se or multiple index assignment predictions per branch per se. Indeed, embodiments of the present invention may omit all three of these enhancements and simply provide a predictive balanced multiple descriptive coder.

Figure 8:
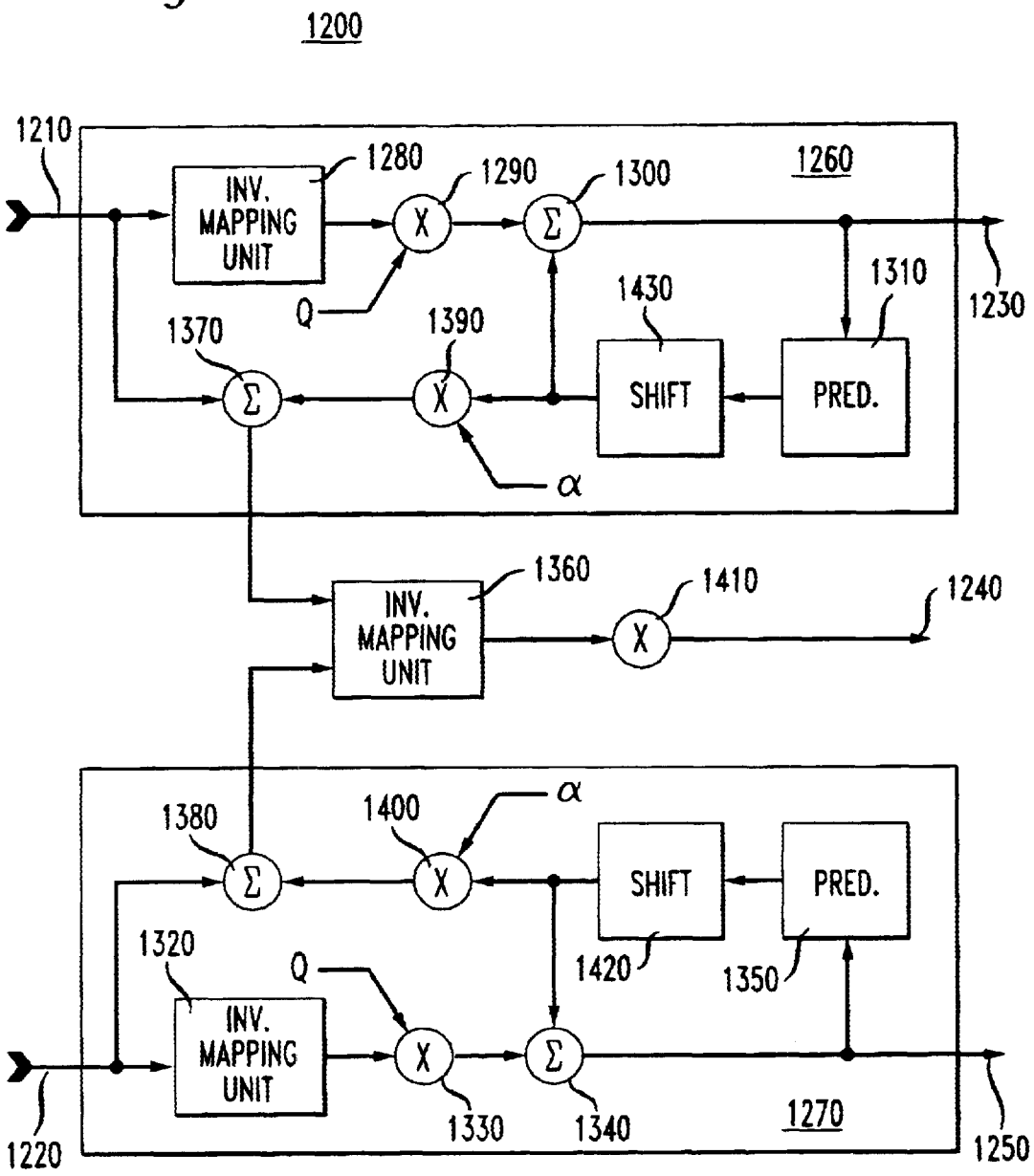
FIG. 8 is a block diagram of a decoder according to another embodiment of the present invention.

FIG. 8 illustrates a decoder 1200 according to an embodiment of the present invention. As shown, the decoder 1200 includes a pair of input terminals 1210, 1220 for respective bin index signals i(t) and j(t) and several output terminals 1230–1250. The decoder 1200 may include a pair of decoding chains 1260, 1270, one for each bin index signal.

A first decoding chain 1260 may include an inverse mapping unit 1280, a multiplier 1290, an adder 1300 a prediction chain that includes a predictor 1310 and a shifting circuit 1430. The inverse mapping unit 1280 recreates a central bin index signal $l_1(t)$ from the bin index signal i(t). The multiplier 1290 scales the recreated bin index signal $l_1(t)$ by the quantizer scalar Q and the adder 1300 adds a predicted source signal to the scaled signal. The adder 1300 outputs a reconstructed source signal $s_1(t)$ based solely upon the bin index signal i(t). The reconstructed source signal $s_1(t)$ may be output on terminal 1230.

In the prediction chain, the predictor 1310 uses the reconstructed source signal $s_1(t)$ at one time instant as a basis for prediction of the source signal at another time instant. The shifting circuit 1430 exploits the mutual refinement property discussed previously. The shifting circuit 1430 outputs a predicted source signal to the adder 1300.

The second prediction chain 1270 may possess a similar structure as the first prediction chain 1260. It may include an inverse mapping unit 1320, a multiplier 1330, an adder 1340 and a predictor 1350. The inverse mapping unit 1320 generates a recreated central bin index signal $l_2(t)$ from the bin index signal j(t). The multiplier 1330 scales the recreated bin index signal $l_2(t)$ by the quantizer scalar Q and the adder 1340 adds a predicted source signal to the scaled signal. The adder 1340 outputs a reconstructed source signal $s_2(t)$ based solely upon the bin index signal j(t). The reconstructed source signal $s_2(t)$ may be output on terminal 1240. The predictor 1350 generates a second predicted source signal from the reconstructed source signal and outputs the second predicted source signal to the adder 1340.

In the second prediction chain, the predictor 1350 and the shifting circuit 1420 may operate in manners similar to those of the first prediction chain, predictor 1310 and shifting circuit 1430.

The decoder 1200 also may include an inverse mapping unit 1360, an additional pair of adders 1370, 1380 and three additional multipliers 1390, 1400, 1410. The multipliers 1390, 1400 scale respective predicted source signals by a scalar $\alpha$. The scalar a represents a scale that is appropriate to render the predicted source signals to a level that is appropriate for the bin index signals. In an embodiment, the scalar $\alpha$ simply may be 1/M where M is the periodicity of the index assignment scheme.

The adders 1370, 1380 add respective bin index signals i(t), j(t) to respective scaled predicted source signals from the multipliers 1390 or 1400. The summed signals both are input the inverse mapping unit 1360. The inverse mapping unit retrieves a central index value l(t) based upon the input signals. The third multiplier 1410 scales the central index value by the quantization scalar Q, thereby generating a third source signal $s_3(t)$.

According to an embodiment of the present invention, when both bin index signals are available to the decoder 1200, the third source signal $s_3(t)$ may be selected to be the decoded signal. When only one of the bin index signals i(t), or j(t) are available to the decoder 1200, an associated output $s_1(t)$ or $s_2(t)$ may be taken to be the decoded source signal.

Figure 9:
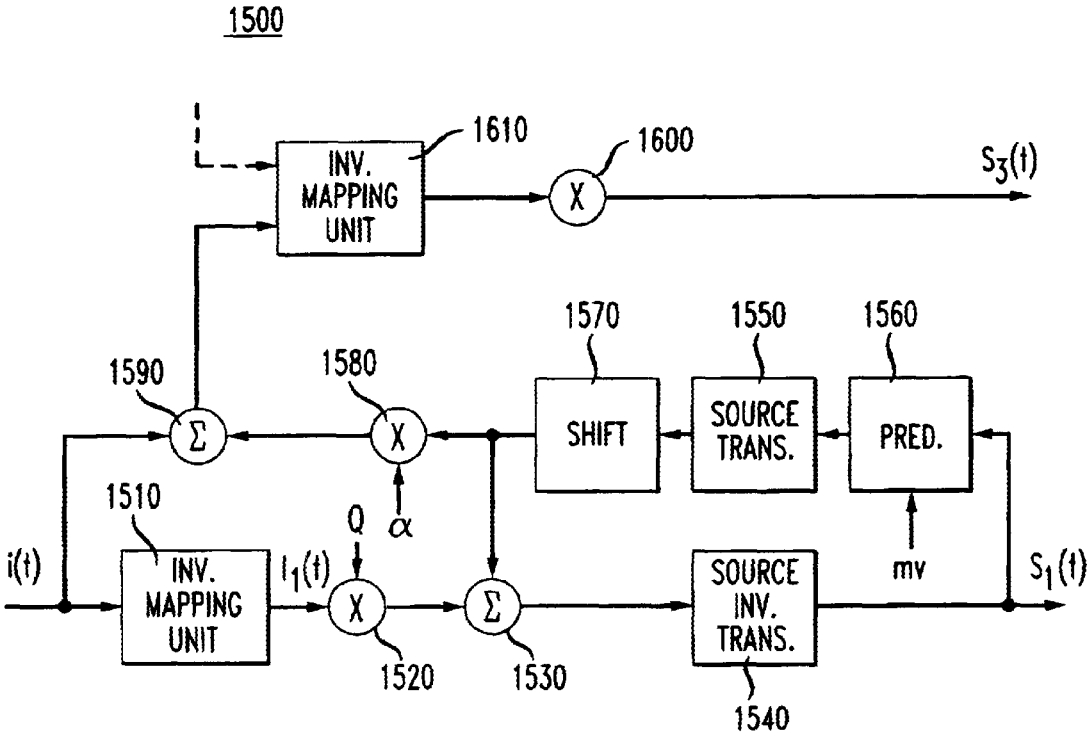
FIG. 9 is a block diagram of a decoding branch according to an embodiment of the present invention.

The enhancements described herein above with respect to the encoder (FIG. 5) also are available to the decoder. FIG. 9 is a partial block diagram illustrating processing of an enhanced decoder 1500 according to an embodiment of the present invention. According to the embodiment, the decoder 1500 may include an inverse mapping unit 1510, a multiplier 1520 and an adder 1530 that operates in accordance with the embodiment above. They generate a first decoded source signal $s_1(t)$ in response to a single bin index signal i(t). The decoding branch may include a predictor 1560 and a shift circuit 1570 that operate in accordance with those of FIG. 8. A decoder 1500 will include a corresponding set of inverse mapping units, adders and multipliers (not shown) to generate a second decoded source signal $s_2(t)$ based solely upon the other bin index signal j(t).

In an embodiment, the decoding branches also may include a source inverse transform 1540 that operates upon a signal output from the first adder 1530. The embodiment also may include a source transform 1550 in a prediction branch in addition to the traditional predictor 1560 and shifter 1570. This embodiment is appropriate to complement those embodiments that provide a source transform during an encoding process.

According to another embodiment, the prediction circuit 1560 may be augmented to perform prediction based on spatial and temporal references received in the data stream. For example, the prediction circuit 1560 may respond to motion vectors generated in the encoder (not shown), by using a predetermined spatial region of reconstructed source data from another time instant as a basis of prediction for source data in a current spatial region at a current time instant.

The decoder 1500 may include additional multipliers 1580,1600, adders 1590 and a third inverse mapping unit 1610 that generates the third reconstructed source signal $s_3(t)$. These elements may operate in accordance with the embodiment of FIG. 8

Several embodiments of the present invention are specifically illustrated and described herein. However, it will be appreciated that modifications and variations of the present invention are covered by the above teachings and within the purview of the appended claims without departing from the spirit and intended scope of the invention.

We claim:

1. A balanced multiple descriptive coder, comprising:

a plurality of coding branches, each coding branch coupled to a common data sources each branch comprising:

1) an encoding circuit comprising:

a) a quantizer, and b) a mapping unit coupled to the quantizer and responsive to a data value from the common data source, the mapping unit generating a respective one of a plurality of index values representative of the data value with reference to an index assignment scheme having uniform spread;

2) a prediction circuit coupled to an output of the encoding circuit, and 3) a subtractor having an input for source data and a second input coupled to the prediction circuit, an output of the subtractor being input to the encoding circuit.

2. The balanced multiple descriptive coder of claim 1, wherein the encoding circuits further comprise a source transform coupled to the subtractor, an output of which is input to the quantizer.

3. The balanced multiple descriptive coder of claim 2, wherein the prediction circuit further comprises an inverse source transform.

4. The balanced multiple descriptive coder of claim 1, wherein:

the prediction circuit includes a prediction analyzer, the encoding circuits further comprise a selection switch controlled by the prediction analyzer and the mapping unit includes a pair of outputs, both coupled to the selection switch.

5. The balanced multiple descriptive coder of claim 1, wherein the prediction circuit comprises:

an inverse mapping unit, a scalar coupled to the inverse mapping unit, an adder having inputs coupled to the scalar and an output of the prediction circuit, and a predictor coupled to the adder.

6. The balanced multiple descriptive coder of claim 5, wherein the predictor is a single sample delay element.

7. The balanced multiple descriptive coder of claim 5, wherein the predictor is a motion compensated predictor.

8. The balanced multiple descriptive coder of claim 5, wherein the prediction circuit further comprises an inverse source transform interposed between the scalar and the adder.

9. The balanced multiple descriptive coder of claim 5, wherein the prediction circuit further comprises a mutual refinability shifter coupled to the predictor.

10. The balanced multiple descriptive coder of claim 5, wherein the prediction circuit further comprises:

a source transform coupled to the predictor, a mutual refinability shifter coupled to the source transform, and an inverse source transform coupled to the shifter.

11. A method of coding a source data signal comprising in each of a pair of coding branches:

generating a respective differential signal representing a difference between the source data signal and a respective predicted source signal, quantizing the respective differential source signal, generating a respective bin index signal accordingly to a mutually refinable index assignment scheme, predicting the respective source signal from the respective bin index signals, and outputting each bin index signal to respective channels.

12. The method of claim 11, further comprising, prior to the quantizing step, source encoding of the respective differential signal in each encoding branch.

13. A balanced multiple descriptive coder, comprising:

a plurality of coding branches, each coding branch comprising:

1) an encoding circuit, comprising:
a) a source transform,
b) a quantizer coupled to the source transform, and
c) a mapping unit coupled toe quantizer and operating in accordance with an index assignment scheme having uniform spread;
2) a prediction circuit, comprising:
a) an inverse mapping unit,
b) a scalar coupled to the inverse mapping unit,
c) an adder having inputs coupled to an input of the encoding circuit and to the scalar,
d) a predictor coupled to the scalar, and
e) an inverse source transform coupled to the predictor and
3) a subtractor having an input for source data and a second input coupled to the prediction circuit, an output of the subtractor being coupled to the encoder circuit.

14. A balanced multiple descriptive coder, comprising:
a plurality of coding branches, each coding branch comprising:
1) an encoding circuit comprising;
a) a quantizer,
b) a mapping unit coupled to the quantizer and operating in accordance with an index assignment scheme having uniform spread, the mapping unit having a pair of outputs, and
c) a selection switch coupled the two outputs of the mapping unit,
2) a prediction circuit, comprising:
a) an inverse mapping unit,
b) a scalar coupled to the inverse mapping unit,
c) an adder having inputs coupled to an input of the encoding circuit and to the scalar,
d) a predictor coupled to the scalar, and
e) a prediction analyzer coupled to a control input of the encoding circuit; and
3) a subtractor having an input for source data and a second input coupled to the prediction circuit, an output of the subtractor being coupled to the encoding circuit.

15. A balanced multiple descriptive coder, comprising:
a plurality of coding branches, each coding branch comprising:
1) an encoding circuits comprising:
a) a quantizer, and
b) a mapping unit coupled to the quantizer and operating in accordance with an index assignment scheme having uniform spread;
2) a prediction circuit, comprising:
a) an inverse mapping unit,
b) a scalar coupled to the inverse mapping unit,
c) an adder having inputs coupled to an input of the encoding circuit and to the scalar, and
d) a motion compensated predictor coupled to the adder; and a subtractor having an input for source data and a second input coupled to the prediction circuit, an output of the subtractor being coupled to the encoding circuit.

16. A balanced multiple descriptive coder, comprising:
a plurality of coding branches, each coding branch comprising:
1an encoding circuit, comprising:
a) a quantizer, and
b) a mapping unit coupled to the quantizer and operating in accordance with an index assignment scheme having uniform spread;
2) a prediction circuit, comprising:
a) an inverse mapping unit,
b) a scalar coupled to the inverse mapping unit,
c) an adder having inputs coupled to an input of the encoding circuit and to the scalar,
d) a predictor coupled to the scalar, and
e) a mutual refinability shifter, coupled to the predictor; and
3) a subtractor having an input for source data and a second input coupled to the prediction circuit, an output of the subtractor being coupled to the encoding circuit.

17. A balanced multiple descriptive decoder, comprising:
1) a pair of decoding chains, each comprising:
a) an inverse mapping unit,
b) a flat scalar coupled to the inverse mapping unit,
c) a first adder coupled to the scalar,
d) a prediction circuit having an input coupled to an output of the adder and an output coupled to an input of the adder,
e) a second scalar coupled to the output of the prediction circuit, and
f) a second adder having inputs coupled to an input of the inverse mapping unit and to the second scalar; and
2) an inverse mapping unit coupled to outputs of the second adders from each decoding chain.

18. The balanced multiple descriptive decoder of claim 16, further comprising an inverse source transform coupled to the first adder.

19. The balanced multiple descriptive decoder of claim 17, wherein the prediction circuit is a single sample delay element.

20. The balanced multiple descriptive decoder of claim 17, wherein the predictor is a motion compensated predictor.

21. The balanced multiple descriptive decode of claim 16, wherein the prediction circuit comprises:
a predictor, and
an inverse source transform interposed between an output of the predictor and an input of the first adder.

22. The balanced multiple descriptive decoder of claim 16, wherein the prediction circuit comprises:
a predictor, and
a mutual refinability shifter coupled to the predictor.

23. The balance multiple descriptive decoder of claim 16, wherein the prediction circuit comprises:
a predictor,
a source transform coupled to the predictor,
a mutual refinability shifter coupled to the source transform, and
an inverse source transform coupled to the shifter.

24. A balanced multiple descriptive decoder, comprising:
1) a pair of decoding chains, each comprising:
a) an inverse mapping unit,
b) a first scalar coupled to the inverse mapping unit,
c) a first adder coupled to the scalar,
d) a inverse source transform coupled to the first adder,
e) a prediction circuit having an input coupled to an output of the inverse source transform;
f) an inverse source transform coupled to an input of the prediction circuit and having an output coupled to an input of the first adder,
g) a second scalar coupled to the output of the prediction circuit, and
h) a second adder having inputs coupled to an input of the inverse mapping unit and to the second scalar; and 2) an inverse mapping unit coupled to outputs of the second adders from each decoding chain.

25. A balanced multiple descriptive decoder, comprising:

1) a pair of decoding chains, each comprising:
   a) an inverse mapping unit,
   b) a first scalar coupled to the inverse mapping unit,
   c) a first adder coupled to the scalar,
   d) a motion compensated prediction circuit having an input coupled to an output of the first adder and an output coupled to an input of the first adder,
   e) a second scalar coupled to the output of the prediction circuit, and
   f) a second adder having inputs coupled to an input of the inverse mapping unit and to the second scalar; and 2) an inverse mapping unit coupled to outputs of the second adders from each decoding chain.

26. A balanced multiple descriptive decoder, comprising:

1) a pair of decoding chains, each comprising:
   a) an inverse mapping unit,
   b) a first scalar coupled to the inverse mapping unit,
   c) a first adder coupled to the scalar, and
   d) a predication circuit, comprising:
      i) a predictor, and
      ii) a mutual refinability shifter coupled to the predictor,
   e) a second scalar coupled to the output of the prediction circuit, and
   f) a second adder having inputs coupled to an input of the inverse mapping unit and to the second scalar; and 2) an inverse mapping unit coupled to outputs of the second adders from each decoding chain.

27. A balanced multiple descriptive decoder, comprising:

1) a pair of decoding chains, each comprising:
   a) an inverse mapping unit,
   b) a first scalar coupled to the inverse mapping unit,
   c) a first adder coupled to the scalar,
   d) a inverse source transform coupled to the adder,
   e) a prediction circuit, comprising;
      i) a predictor,
      ii) a source transform coupled to the predictor,
      iii) a mutual refinability shifter coupled to the source transform, and
      iv) an inverse source transform coupled to the shifter,
   f) a second scalar coupled to the output of the prediction circuit, and
   g) a second adder having inputs coupled to an input of the inverse mapping unit and to the second scalar; and 2) an inverse mapping unit coupled to outputs of the second adders from each decoding chain.

28. The balanced multiple descriptive coder of claim 1, wherein the encoding circuit associated with each of the plurality of coding branches generates a respective index value from the data value, the collection of index values uniquely representing the data value according to the index assignment scheme.

29. The balanced multiple descriptive coder of claim 13, wherein the encoding circuit associated with each of the plurality of coding branches generates a respective index value from the data value, the collection of index values uniquely representing the data value according to the index assignment scheme.

30. The balanced multiple descriptive coder of claim 14, wherein the encoding circuit associated with each of the plurality of coding branches generates a respective index value from the data value, the collection of index values uniquely representing the data value according to the index assignment scheme.

31. The balanced multiple descriptive coder of claim 15, wherein the encoding circuit associated with each of the plurality of coding branches generates a respective index value from the data value, the collection of index values uniquely representing the data value according to the index assignment scheme.

32. The balanced multiple descriptive coder of claim 16, wherein the encoding circuit associated with each of the plurality of coding branches generates a respective index value from the data value, the collection of the index values uniquely representing the data value according to the index assignment scheme.

33. The balanced multiple descriptive coder of 1, wherein the prediction circuit of each coding branch operates independently of the prediction circuit of every other coding branch.

34. The balanced multiple descriptive coder of claim 1, wherein the prediction circuit of each coding branch generates a prediction of a source data value based on a predicted index value of the coding branch to which the prediction circuit belongs but no other index values.

* * * * *